United States Patent [19]

Green et al.

[11] 4,233,598

[45] Nov. 11, 1980

[54] EMERGENCY STOP CIRCUIT MONITORING SYSTEM

[75] Inventors: Robert J. Green; Gerald A. Hales, both of Deptford, England

[73] Assignee: Molins Limited, England

[21] Appl. No.: 934,884

[22] Filed: Aug. 18, 1978

[30] Foreign Application Priority Data

Aug. 30, 1977 [GB] United Kingdom ..... 36119/77

[51] Int. Cl.[3] ..... G08B 25/00

[52] U.S. Cl. ..... 340/652; 340/524

[58] Field of Search ..... 340/52 F, 292, 506, 340/510, 511, 512, 521, 524, 525, 599, 644, 652, 653, 661, 664

[56] References Cited

U.S. PATENT DOCUMENTS 3,813,665 5/1974 Parfomak et al. ..... 340/661

4,118,700 10/1978 Lenihan ..... 340/524

FOREIGN PATENT DOCUMENTS 1391131 4/1975 United Kingdom .

1475417 6/1977 United Kingdom .

*Primary Examiner*—Alvin H. Waring

*Attorney, Agent, or Firm*—Craig & Antonelli

[57] ABSTRACT

Monitoring system for an emergency stop circuit controlling a number of machines in a factory, to determine the location of an actuated stop button. The stop circuit consists of a supply line to a self-latching contactor and there is an emergency stop button in the circuit at each machine. A monitoring line runs parallel to the supply line and is connected to each section between adjacent stop buttons by high value resistors. When a voltage is applied to the supply line a current appears in the monitoring line whose magnitude depends upon the position of the actuated stop button and thus is connected to a voltage which is applied to a series of comparators driving light emitting diodes. Each comparator is provided with a different reference voltage from a resistive chain and since the L.E.D.'s are connected between the outputs of successive comparators along the chain, only the L.E.D. whose position represents the position of the actuated button is illuminated.

8 Claims, 1 Drawing Figure

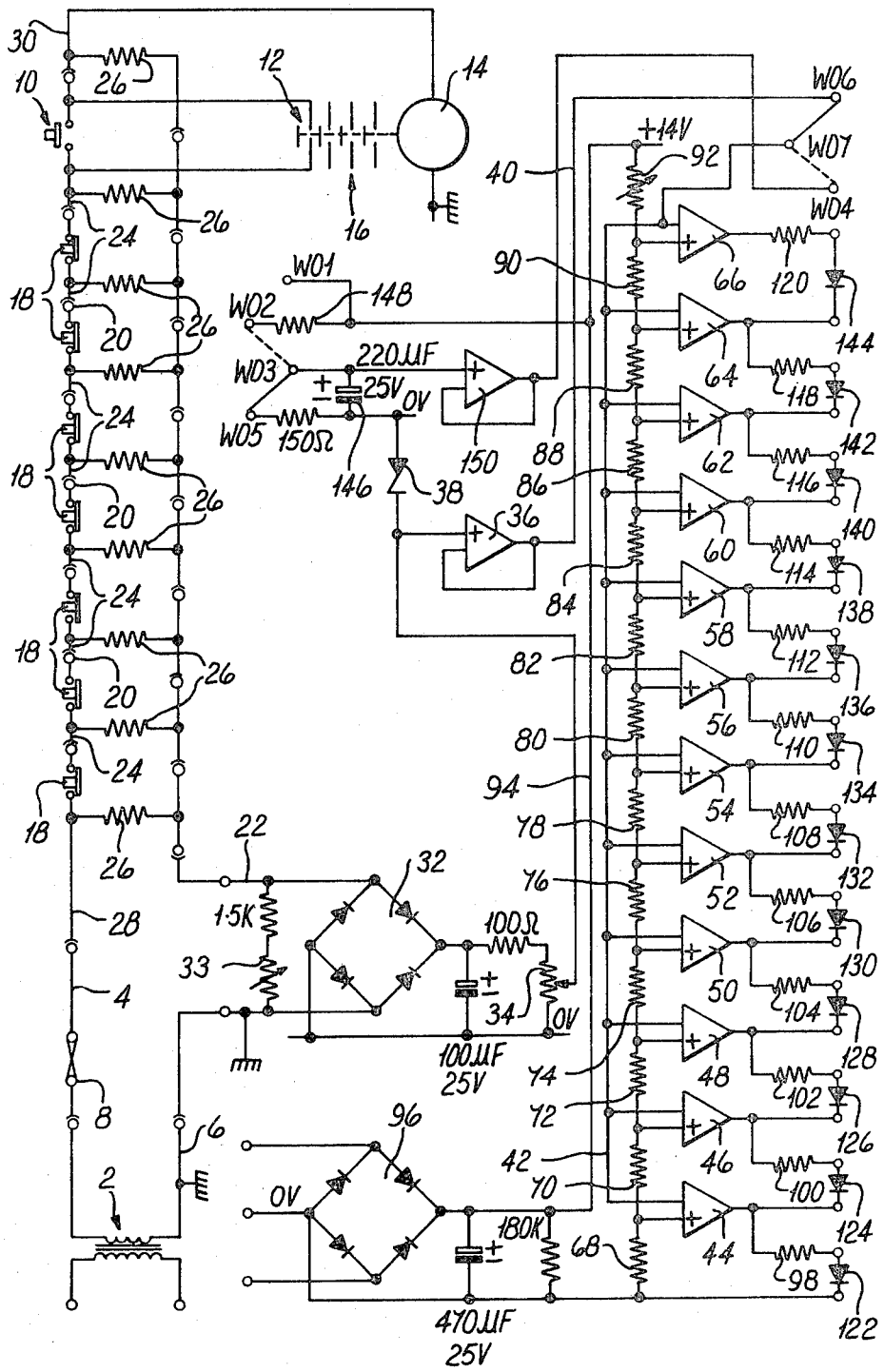
30
10
26
12
14
16
24
18
20
W01
W02
148
W03
220µF
25V
0V
W05
150Ω
146
38
150
36
40
+14V
92
W06
W07
W04
90
66
120
144
64
118
142
62
116
140
60
114
138
58
112
136
56
110
134
54
108
132
52
106
130
50
104
128
48
102
126
46
100
124
44
98
122
88
86
84
82
80
94
78
76
74
72
42
70
68
22
32
1·5K
33
100Ω
34
100µF
25V
28
4
8
6
2
96
180K
470µF
25V

EMERGENCY STOP CIRCUIT MONITORING SYSTEM

This invention relates to remote control systems for starting up machinery in factories, particularly where a number of machines operating in unison are spread over a large area in a factory.

Commonly the machines are started up by a push button in a central control panel which latches on a relay connecting the machines to the power supply. In order to allow the machines to be rapidly shut off in any case of emergency at any particular location, each machine must be provided with a "stop" button which is arranged in the power supply line to the relay coil so as to break the circuit when actuated and thus cause the relay to unlatch, so that all the machines are stopped. The circuit interconnecting all the stop buttons and the relay coil is commonly known as a "stop circuit". Safety regulations generally require that such "stop" buttons will remain in the "off" position, so that before all the machinery can be re-started, all of the stop buttons must be reset.

Similarly if the "stop circuit" develops a fault at any point, or if a plug and socket connection in the circuit comes loose, this must be detected and corrected before the machinery can be re-started, and it will be appreciated that in a large factory with a considerable number of machines and a correspondingly large number of emergency stop buttons, a great deal of time can be wasted trying to locate a fault in the stop circuit or an actuated stop button, when the machinery will not start up when the "start" button is actuated.

Accordingly the present invention aims to provide a simple monitoring system which is adapted to rapidly indicated the section at which an open circuit condition has occurred in a power supply line comprising a series of sections joined by connectors and/or switches. Such a system will be referred to hereinafter as "a monitoring system of the type described".

A monitoring system of the type described according to the invention comprises an electrical impedance network for connection to the supply line in such a way as to provide, when the line is connected to a power supply, an analogue voltage representing the position of the furthest "live" section in the supply circuit from the "live" terminal of the supply, i.e. a voltage dependent upon the position of a fault. Preferably the impedance network comprises a plurality of monitoring impedances each of which is connected, in use, to a different section of the supply line and also to a common parallel monitoring line, so that the magnitude of the current in the monitoring line depends upon the number of impedances connected to live sections of the supply line.

The current in the monitoring line may then be passed through a known summing resistor to provide the analogue voltage. The level of the voltage may be indicated by indicator means including comparators arranged to compare the level of the analogue voltage with a plurality of present reference voltages, which are preferably derived from the supply used to activate the line (which may be the main supply, or may be independent of the mains) so that they vary with any variations of the supply voltage.

There are preferably as many reference voltages as there are junctions in the line, although it will be appreciated that in some cases it will be adequate to provide one reference voltage for each larger section, which includes two or more junctions, if these junctions are all physically close together so that they can all be easily checked at once if a fault is indicated in the larger section.

Preferably, a plurality of reference voltages are provided, each corresponding to a predetermined section of the supply line, by means of a resistive chain across which is applied a voltage at least equal to the maximum possible voltage across the summing resistor. Each junction between adjacent resistors can thus provide one of the reference voltages. The comparator amplifiers each have one of their inputs connected to one of the junctions and the other input connected across the summing resistor. Thus each comparator will give a "high" output if its reference voltage is higher than the summing resistor voltage, and a "low" output if its reference voltage is lower than the summing resistor voltage (or vice versa depending of course on the particular circuit arrangement).

Preferably the indicator means comprises a plurality of voltage sensitive indicators such as L.E.D.'s, each of which is connected between the outputs of two electrically adjacent comparator amplifiers, i.e. two which are connected to successive junctions in the resistive chain. When an open circuit condition occurs in the supply line, the comparators "upstream" of the fault (i.e.nearer he live terminal of the mains) will all give "high" outputs whilst those downstream will all give "low" outputs. Thus only the L.E.D. at the fault position will be subjected to a difference in voltage which will cause it to be illuminated.

The invention also extends to a circuit for indicating the level of an analogue voltage, comprising a series chain of impedance elements which is supplied with a voltage at least equal to the maximum value of the analogue voltage, a corresponding number of comparator devices each having one input connected to a different junction of the chain, and the other input connected to the source of the analogue voltage; and a corresponding number of voltage sensitive indicating devices, each indicating device connecting the output of one comparator to that of the next comparator, so that any indicator device which is connected between two comparator outputs which are both "low" or both "high" will be in an "off" condition, but an indicator device which is connected between the outputs of two comparators which are at different levels will be in an "on" condition.

According to a further aspect of this invention a power supply circuit including a number of potentially faulty sections has a monitoring circuit for detecting the position of a fault in the circuit, the monitoring circuit including a number of impedances connected to the respective sections of the power supply circuit so that a test current can be passed through the monitoring circuit to detect the total operative impedance of the monitoring circuit which is dependent upon the number of the impedance through which the current passes and is thus indicative of the position of the fault.

One embodiment of the invention will now be described by way of example with reference to the accompanying drawing, which is a circuit diagram of a "stop circuit" with a monitoring system in accordance with the invention.

Referring to the drawing, a mains transformer 2 provides an output of 110 V ac on the line 4 of the stop circuit whilst line 6 is connected to earth. A fuse 8 is connected between the transformer 2 and the line 4.

A start button 10 is connected in parallel with a normally-off contact set 12 of a contactor and in series with the contactor coil 14 so that depression of the start button normally latches the contactor "on". A number of electrical machines (not shown) are connected to a main supply via the other normally-off contact sets 16 of the contactor so that they will only be supplied with power if the contactor latches on.

An emergency "stop" button 18 is provided in the line 4 at the location of each of the machines, and there may also be a number of plug and socket connectors 20 in the line. Thus if one of these stop buttons is in the "off" position, or if there is a loose connection between a plug and socket, causing an open circuit in the line 4, the contactor 14 will be prevented from latching "on".

The monitoring system includes a monitoring line 22 arranged in parallel with line 4, and connected to each of the individual sections 24 between the stop buttons by means of high value resistors 26 having values of 100 K each in the illustrated example. A resistor 26 is also connected to the section 28 between the first stop button in the line and the fuse 8, and another resistor 26 is connected to the section 30 between the start button 10 and the contactor coil 14.

The monitoring line 22 is connected across a summing resistor 33 (which is variable with a minimum value of 1.5 K Ω in the illustrated example) to one input terminal of a full-wave bridge rectifier 32, the other input terminal being connected to earth. The d.c. output of the bridge rectifier is connected to a potentiometer 34 to allow the output to be adjusted to the required level, as explained below, and the output from the potentiometer is fed to an amplifier 36 connected in a "voltage follower" configuration to act as a buffer. A zener diode 38 is connected between the input of amplifier 36 and earth to ensure that the voltage at the input of the amplifier does not rise above a present level (in the illustrated case, 13 V).

The output from the amplifier 36 is normally connected via line 40 and terminal W06, through a changeover switch to terminal W07. (The other position of the changeover switch connects terminal W07 to terminal W04 for reasons to be explained in more detail below). Terminal W07 is in turn connected to line 42, which drives a series of twelve comparator amplifiers 44–66 via their inverting inputs.

The non-inverting input of each amplifier is connected to one of the junctions between adjacent resistors of a resistor chain 68, 70 . . . 88,90, which is fed via a variable resistor 92 from a d.c. reference voltage line 94 (supplied with 14 V in the illustrated example). The d.c. supply is derived from the 110 V mains supply via a low voltage transformer (10 V a.c.) (not shown) and a bridge rectifier 96, so that any variations in the mains voltage will be followed by the d.c. reference voltage supply line 94.

The resistor chain acts as a potential divider, so that each junction of the chain is at different preset d.c. reference voltage. Thus when one of the stop buttons 18 has been pressed, the resultant voltage on line 42, which is dependent upon the position of the actuated stop button, will be compared, by each of the comparators, with a different reference voltage. Those comparators which are being supplied with a reference voltage which is above the voltage on line 42 will therefore give a "high" output whilst those which are being supplied with a reference voltage lower than that of line 42 will give a "low" output. It will be apparent that the "location" of the fault is given by the point on the resistor chain at which the voltage equals that on line 42, i.e. between the two adjacent comparators which have different output voltages.

In order to give an unambiguous indication of this position, therefore, an L.E.D. 122, 124 . . . 142, 144 is connected between the output of each amplifier and that of the next succeeding amplifier, so that only the L.E.D. which corresponds to the correct "fault" position will experience a voltage difference causing it to be activated. (It will be appreciated that the amplifier outputs must be able to either "source" or "sink" sufficient current to operate an L.E.D.). In each case a resistor (98, 100 . . . 118, 120, value 1 KΩ in the example) is connected in series with the L.E.D. to limit the current.

In order to initially set up the system, the variable resistor 92 is adjusted so that a level of 0.8 V d.c. (in the illustrated example) is achieved at the junction between resistors 68 and 70. The potentiometer 33 is adjusted so that when the first stop button is pressed, the voltage at the d.c. output of bridge rectifier 32 is 1 V. The potentiometer 34 is then adjusted so that the voltage on line 42 is 0.9 V.

This will result in a clear indication of a fault condition by L.E.D. 124, which is the second L.E.D. in the line (the first L.E.D. 122 indicates the condition of fuse 8).

In order to test the circuit for correct operation, a double-pole changeover switch is actuated which disconnects terminal W03 from terminal W05 and connects it instead to W02, which is connected to the +14 V line 94. The +14 V supply is therefore connected to capacitor 146, which was previously discharged (because of the connection W02–W05) so that it now charges up through resistor 148. The time constant is of the order of 10 seconds so that the voltage at the input of amplifier 150 rises over a number of seconds to its final value.

The changeover switch also disconnects terminal W07 from W06 (i.e. from the monitoring line) and connects it instead to terminal W04, i.e. the output of amplifier 150. Thus line 42 is supplied with the rising output of the amplifier so that if the circuit is operating correctly, each of the L.E.D.'s 122–124 will be illuminated in turn when the "test" switch is actuated, as the voltage across capacitor rises.

The components of the circuit in the exemplary system illustrated (for 110 V supply) are as follows:

| | |
|---|---|
| Diode bridge 32: | 4 × type IN923 |
| Diode bridge 96: | 4 × type 10D4 |
| Amplifiers 44–66, 36, 150: | type LM324 (quad) |
| Zener diode 38: | type BZY88/C13 |
| Resistors | |
| 26: 100 KΩ | 148:56 KΩ |
| 68, 70 . . . 88,90: | 1 KΩ |
| 98, 100 . . . 118,120: | 1 KΩ |
| Variable Resistors | |
| 34: 1 KΩ | 92: 10 KΩ |
| 33: 10 KΩ(variable, plus 1.5KΩ fixed) | |

We claim:

1. A monitoring system for use with a power supply line including a series of sections in which open circuit conditions may occur, said monitoring system comprising: a plurality of monitoring impedances each having one side connected to a different section of the supply line; a common monitoring line connected in parallel to said sections of said supply line; the other side of each monitoring impedance being connected to the monitoring line; summing means connected to the monitoring line for summing the currents in the monitoring impedances and for producing an analogue voltage proportional to the sum of the said currents; comparator means adapted to compare the said analogue voltage with a plurality of preset reference voltages; and indicator means connected to the said comparator means so as to provide an indication of the level of the analogue voltage and thus the position of the supply interruption.

2. A monitoring system according to claim 1 in which the said preset reference voltages are derived from the same supply as that used to activate the supply line, whereby variations in the supply voltage are automatically compensated by corresponding variations in the reference voltages.

3. A monitoring system according to claim 2 in which the reference voltages are produced by means of a resistive chain across which is applied a voltage at least equal to the maximum possible voltage across the summing means.

4. A monitoring system as claimed in claim 3 in which the comparator means comprises a plurality of comparator amplifiers, each having one input connected across the summing resistor and the other input connected to one of the junctions between the resistors of the resistive chain.

5. A monitoring system according to claim 4 further comprising a respective voltage sensitive indicating device connected between the outputs of each pair of comparator amplifiers which are connected to successive junctions of the resistive chain; whereby an indication will be given, in use, by the indicating device whose position in the circuit relative to the resistive chain corresponds to the position in the circuit of the fault in the supply line.

6. A monitoring system according to claim 5 in which the voltage sensitive indicating devices are light emitting diodes.

7. A power supply circuit including a number of sections in which possible faults are to be detected, having a monitoring circuit including a parallel monitoring line and a number of impedances each connected between a respective section of the power supply circuit and the parallel monitoring line so that the total operative impedance of the monitoring circuit is dependent upon the number of the impedances connected to live sections of the power supply line and is thus indicative of the position of the fault.

8. A monitoring system for an energency stop circuit in which any one a plurality of energency stop buttons may be actuated at various remote locations in the circuit to break the circuit, the monitoring system being adapted to indicate the region of the open circuit condition and comprising: means for generating an analogue voltage related to the position of the open circuit condition, a series chain of impedance elements which is supplied with a voltage at least equal to the maximum value of the analogue voltage, a corresponding number of comparator devices each having one input connected to a different junction of the chain, and the other input connected to the source of the analogue voltage; and a corresponding number of voltage sensitive indicating devices, each indicating device connecting the output of one comparator to that of the next comparator, so that any indicator device which is connected between two comparator outputs which are both "low" or both "high" will be in an "off" condition, but an indicator device which is connected between the outputs of two comparators which are at different levels will be in an "on" condition.

* * * * *